US006837748B2

(12) United States Patent
Aldridge

(10) Patent No.: US 6,837,748 B2
(45) Date of Patent: Jan. 4, 2005

(54) CONNECTOR

(75) Inventor: Ian Edward Aldridge, Hampshire (GB)

(73) Assignee: Contour Electronics Limited, Hampshire (GB)

( * ) Notice: Subject to any disclaimer, the term of this patent is extended or adjusted under 35 U.S.C. 154(b) by 0 days.

(21) Appl. No.: 10/682,692

(22) Filed: Oct. 9, 2003

(65) Prior Publication Data

US 2004/0092169 A1 May 13, 2004

(30) Foreign Application Priority Data

Nov. 13, 2002 (GB) ..... 0226479

(51) Int. Cl.[7] ..... H01R 24/00

(52) U.S. Cl. ..... 439/660; 439/79; 439/885; 29/875

(58) Field of Search ..... 439/79–82, 660, 439/885; 29/875

(56) References Cited

U.S. PATENT DOCUMENTS

| | | | | |
|---|---|---|---|---|
| 5,174,764 | A | 12/1992 | Kandybowski et al. | |
| 5,816,829 | A | 10/1998 | Chiang | |
| 6,200,171 | B1 | 3/2001 | Fusselman et al. | |
| 6,422,902 | B1 | 7/2002 | Ogren et al. | |
| 6,506,063 | B1 * | 1/2003 | Moriwake et al. | 439/79 |

FOREIGN PATENT DOCUMENTS

| | | |
|---|---|---|
| EP | 0 578 881 A1 | 1/1994 |
| EP | 1083629 | 3/2001 |

* cited by examiner

*Primary Examiner*—Truc T. T. Nguyen
(74) *Attorney, Agent, or Firm*—George R. McGuire; Bond, Schoeneck & King, PLLC

(57) ABSTRACT

A connector comprising a body; a plurality of terminals and a plurality of signal contacts. The terminals are arranged in two substantially parallel rows on one face of the body. A signal contact is connected to each terminal and all of the signal contact extend from another face of the body in a single row substantially parallel to the row of terminals.

7 Claims, 4 Drawing Sheets

CONNECTOR

CROSS REFERENCE TO RELATED APPLICATION

The present application claims priority to Great Britain Patent Application No. GB0226479.4, filed Nov. 13, 2002.

BACKGROUND OF THE INVENTION

The present invention relates to a power connector and a method of manufacturing the connector.

In the past it has proved difficult to deliver the required combination of power and signal contacts whilst fulfilling both the space constraints and the IP67 standard for water sealing. The aim of the present invention is to provide a compact connector which incorporates both power and signal contacts within a single housing.

SUMMARY OF THE INVENTION

According to the present invention there is provided a connector comprising: a body; a plurality of terminals arranged in two substantially parallel rows on one face of the body; and a plurality of signal contacts, one connected to each terminal and extending from another face of the body in a single row substantially parallel to the row of terminals.

Preferably, the connector further comprises a plurality of power contacts connected to the body and extending in a row substantially parallel to the row of signal contacts.

According to the present invention there is further provided a method of manufacturing an array of signal contacts for a connector, the method comprising the steps of: forming two subarrays of contacts, each contact having a terminal at one end, wherein the subarrays are held substantially parallel to one another by respective end strips each having positioning means; and wherein the terminals of each respective sub-array are disposed in separate rows parallel to one another; lining up the positioning means on the two subarrays; pressing the end strips together so that the sub-arrays form a single array with the signal contacts in a single row; insert moulding the terminals in a connector body; and thereafter removing the end strips from the signal contacts.

A method of manufacturing a connector may provided comprising steps of: manufacturing an array as detailed above, insert moulding a set of power contacts having a end strip into the connector body; and removing the end strip from the power contacts.

Preferably, the positioning means comprise a recess on one subarray and a projection on the other.

BRIEF DESCRIPTION OF THE DRAWINGS

An example of a connector according to the present invention will now be described with reference to the accompanying drawings in which.

DETAILED DESCRIPTION

Figure 8:
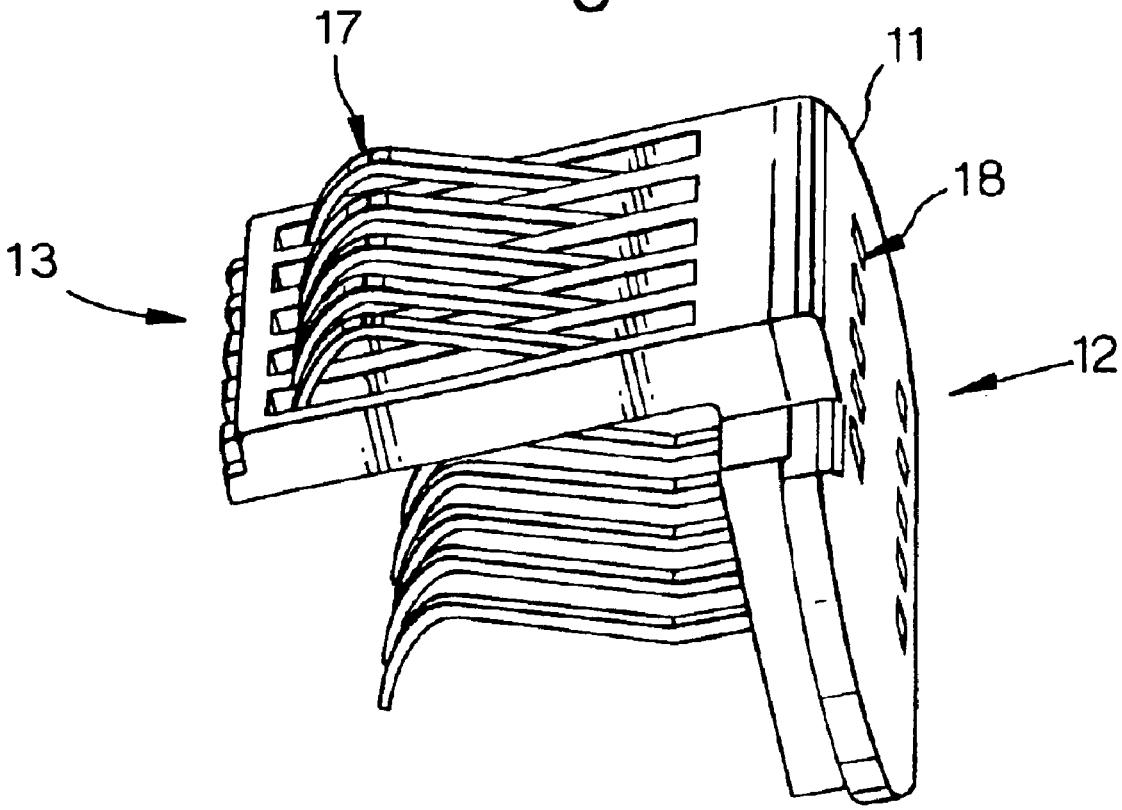
FIG. 8 shows a completed connector according to the present invention.

In FIG. 8 is shown a completed connector 10 comprising a body 11 with two rows of holes 14, 15 for terminal contacts on the front face 12 thereof. The two rows of holes 14, 15 are substantially parallel. Extending from the rear face 13 of the body 11 is an array of elongate signal contacts 16. An array of elongate power contacts 17 also extends from the rear face 13 of the body 11. The array of power contacts 17 is substantially parallel to the array of signal contacts 16.

The method steps used to manufacture the connector 10 shown in FIG. 8 are shown in FIGS. 1 to 7.

Figure 1:
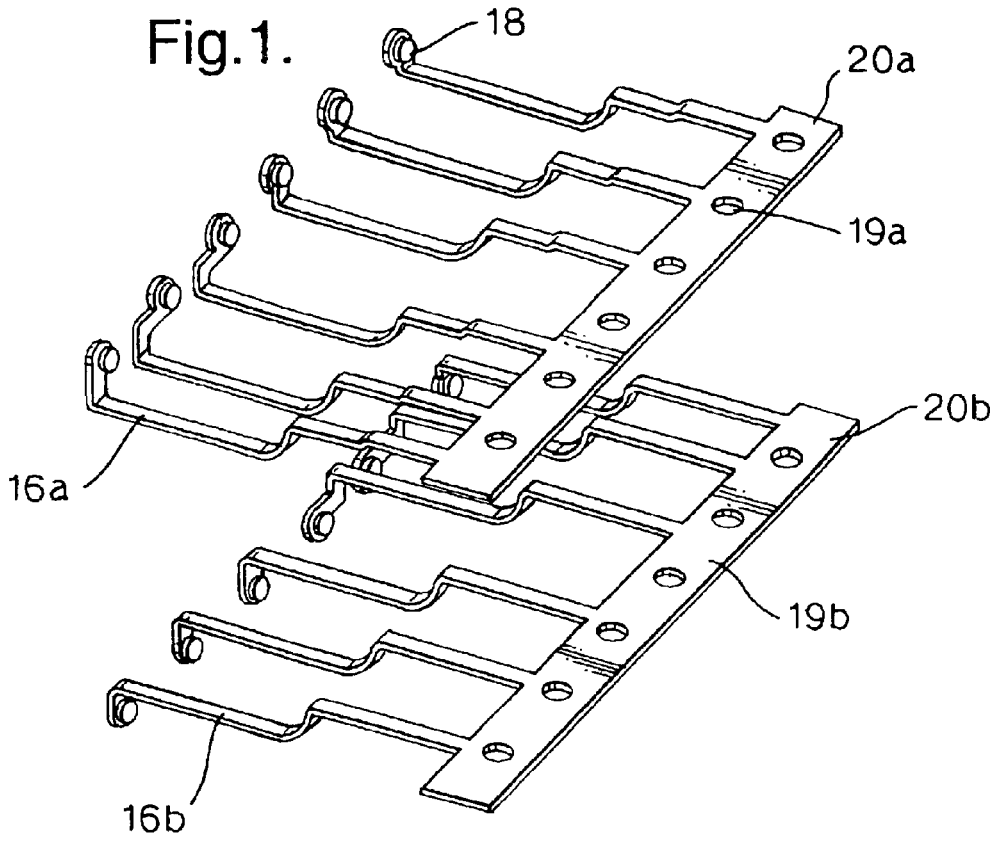
FIG. 1 shows two subarrays of signal contacts.
Figure 2:
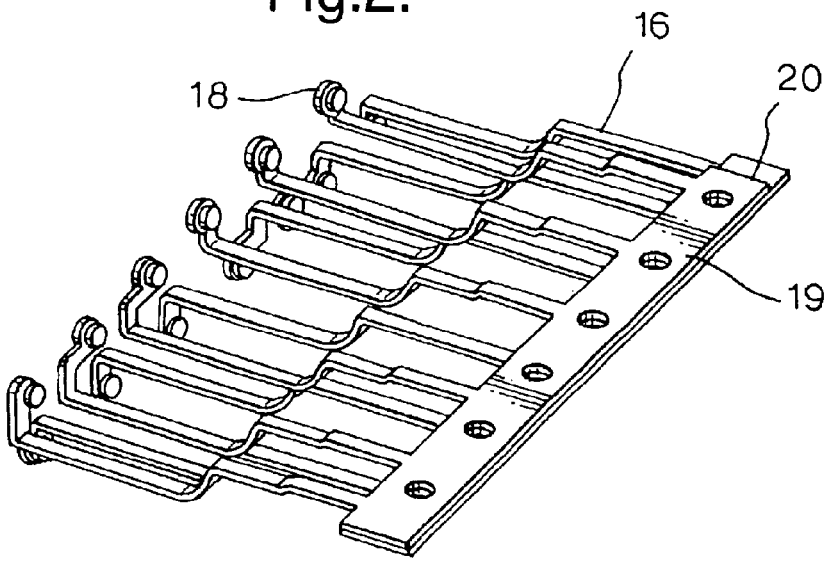
FIG. 2 shows the two subarrays combined to form a single array.

FIG. 1 shows two subarrays of elongate signal contacts 16*a*, 16*b*. Each signal contact has a terminal 18 at one end and is formed from phosphor bronze or a copper alloy, and the signal contacts of each subarray 16*a*, 16*b* are held in a substantially parallel configuration by respective end strips 19*a*, 19*b*. On the end strips 19*a*, 19*b* there are respective positioning means 20*a*, 20*b*, in the form of a series of recesses 20*a* and a series of projections 20*b*. The positioning means 20*a*, 20*b* allow the two end strips to be engaged with one another so that the subarrays of signal contacts 16*a*, 16*b* are lined up so that they form a single array 16. As a result of the configuration of the signal contacts, the terminals 18 are in two substantially parallel rows. FIG. 2 shows the single array 16.

Figure 3:
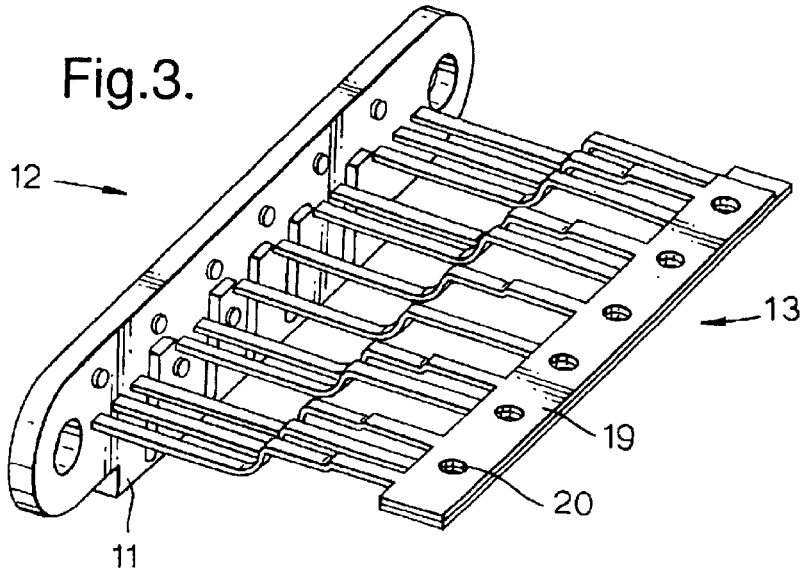
FIG. 3 shows an array insert moulded into a body.
Figure 4:
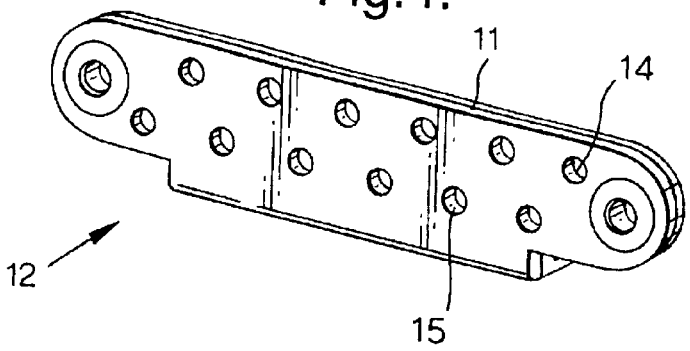
FIG. 4 shows a front face of a body.

This array of signal contacts 16 is then insert moulded onto a plastics, insulating body 11 as shown in FIG. 3. The insert moulding process involves inserting the body 11 into a mould and moulding material, preferably PBT 15% glass filled UL94-VO, around it in order to connect the terminals 18 of the signal contacts 16 with the two rows of holes 14, 15 in the body 11 (shown in FIG. 4) such that the signal contacts extend in an array 16 from the rear face 13 of the body 11.

Figure 5:
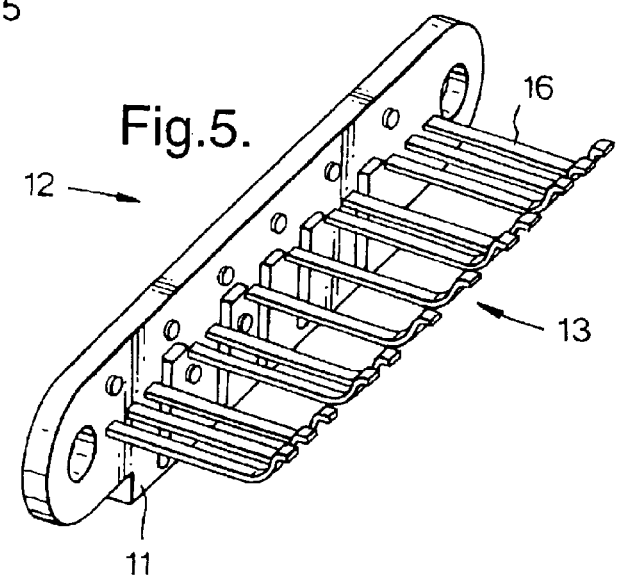
FIG. 5 shows an array and a body once an end strip has been removed.

Once this insert moulding process is complete the end strips 19 can be removed to leave one substantially parallel array of signal contacts 16 extending from the rear face 13 of the body 10. This is shown in FIG. 5.

Figure 6:
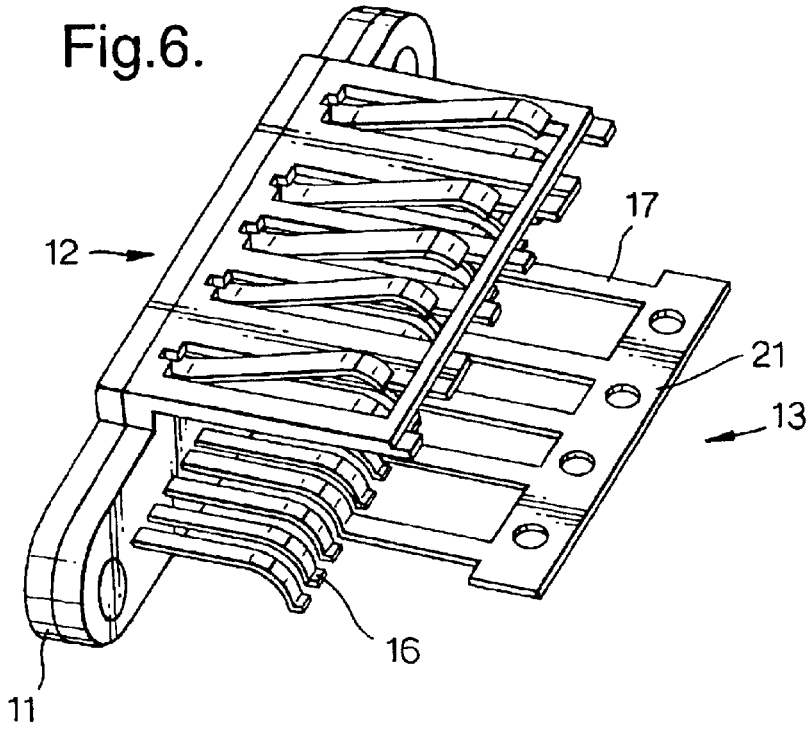
FIG. 6 shows a power contacts insert moulded into a body.
Figure 7:
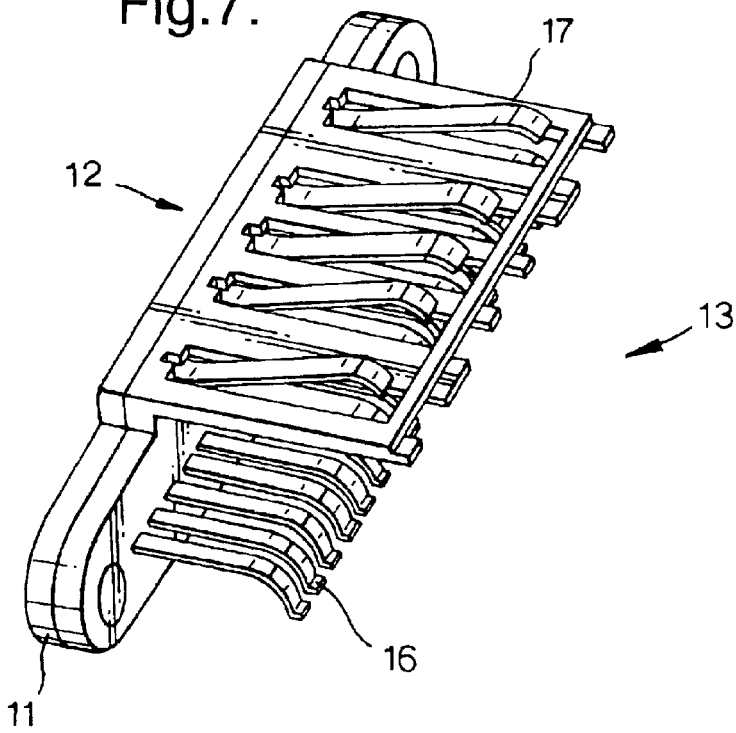
FIG. 7 shows a connector once the power contact end strip has been removed.

A further process of insert moulding is then undertaken to mould an array of power contacts 17 into the body 11. This is shown in FIG. 6. The moulding material is preferably PA6T 15% glass filled UL94-VO. The moulding material is different from the material used in the first phase of insert moulding to ensure that the front face of the connector does not bow. It is also possible to alter the thicknesses of the first and second stage insert moulding (whilst maintaining the same overall thickness) in order to ensure that the front face does not bow. The power contacts 17 are held in a substantially parallel array by an end strip 21 and the moulding results in the array of power contacts 17 being substantially parallel to the array of signal contacts 16 extending from the reverse face 13 of the body 11. Once the insert moulding process is complete the end strip 21 is removed as shown in FIG. 7. The signal contacts 16 are then bent into the desired shape on the rear of the body 11.

What is claimed is:

1. A method of manufacturing an array of signal contacts for a connector, the method comprising the steps of:

forming two subarrays of contacts, each contact having a terminal at one end, wherein the subarrays are held substantially parallel to one another by respective end strips each having positioning means; and wherein the terminals of each respective sub-array are disposed in separate rows parallel to one another;

lining up the positioning means on the two subarrays;

pressing the end strips together so that the sub-arrays form a single array with the signal contacts in a single row;

insert moulding the terminals in a connector body; and thereafter removing the end strips from the signal contacts.

2. A method of manufacturing a connector according to claim 1, the method further comprising the step of:

insert moulding a set of power contacts having a end strip into the connector body; and removing the end strip from the power contacts.

3. A method of manufacture according to claim 2, wherein the positioning means comprise a plurality of recesses on one subarray and a corresponding set of projections on the other.

4. A method of manufacture according to claim 1, wherein the positioning means comprise a plurality of recesses on one subarray and a corresponding set of projections on the other.

5. An array of signal contacts for a connector, the array comprising:

two subarrays of contacts, each contact having a terminal at one end;

wherein the terminals of each respective subarray are disposed in separate rows parallel to one another;

each subarray having a respective removeable end strip having a positioning means for holding the subarrays substantially parallel to another;

wherein said positioning means are capable of being aligned such that, when pressure is applied, a single array is formed with said signal contacts in a single row; and wherein said array is capable of being insert molded into a connector body.

6. A connector, comprising:

a connector body; and an array of signal contacts, wherein said array of signal contacts comprises:

two subarrays of contacts, each contact having a terminal at one end;

wherein the terminals of each respective subarray are disposed in separate rows substantially parallel to one another;

each subarray having a respective removeable end strip having a positioning means for holding the subarrays substantially parallel to another;

wherein said positioning means are capable of being aligned such that, when pressure is applied, a single array is formed with said signal contacts in a single row; and wherein said array is capable of being insert molded into a connector body.

7. A connector according to claim 6, further comprising a plurality of power contacts connected to said body and extending in a row substantially parallel to the row of signal contacts.

* * * * *